US006622315B1

(12) United States Patent
Feygin et al.

(10) Patent No.: US 6,622,315 B1
(45) Date of Patent: Sep. 23, 2003

(54) TOILET BOWL DEODORIZING AND DISINFECTING APPARATUS

(76) Inventors: Ilya Feygin, 853 Hillside Ave., Mountainside, NJ (US) 07092; Mark Rozentsvayg, 536 Monroe Ct., River Edge, NJ (US) 07661

( * ) Notice: Subject to any disclaimer, the term of this patent is extended or adjusted under 35 U.S.C. 154(b) by 0 days.

(21) Appl. No.: 10/263,934

(22) Filed: Oct. 3, 2002

Related U.S. Application Data

(60) Provisional application No. 60/326,883, filed on Oct. 3, 2001.

(51) Int. Cl.[7] ..... E03D 9/00

(52) U.S. Cl. ..... 4/223; 4/229

(58) Field of Search ..... 4/223, 229, 233, 4/237, 420.4, 447

(56) References Cited

U.S. PATENT DOCUMENTS 3,249,951 A * 5/1966 Thompson ..... 4/229

5,742,952 A * 4/1998 Huang ..... 4/420.4

* cited by examiner

*Primary Examiner*—Robert M. Fetsuga

(57) ABSTRACT

A toilet bowl deodorizing, disinfecting and washing apparatus. In one variation, the apparatus includes a flexible enclosure that contains a bellows, a high-pressure reservoir, a liquid reservoir, and a plurality of nozzles. The bellows, liquid reservoir, and nozzles are selectively placed in fluid communication with the high-pressure reservoir. In use, the flexible enclosure is disposed beneath a toilet seat (or is itself a toilet seat). Deodorizing/disinfecting/washing liquid, which is contained in the liquid reservoir, is admitted to the high-pressure reservoir. When a person sits on the flexible enclosure, the bellows compresses air that is admitted to the high-pressure reservoir, thereby pressurizing the deodorizing/disinfecting/washing liquid that is contained therein. As the person gets off the flexible enclosure, the high-pressure reservoir is connected to the nozzles such that pressurized deodorizing/disinfecting/washing liquid is dispensed.

12 Claims, 3 Drawing Sheets

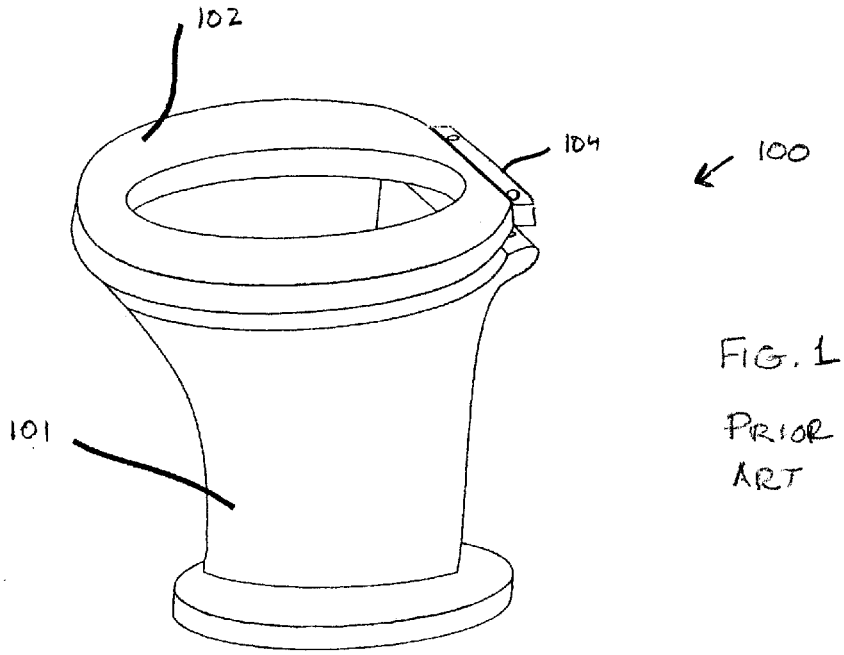
FIG. 1
PRIOR ART
FIG. 2
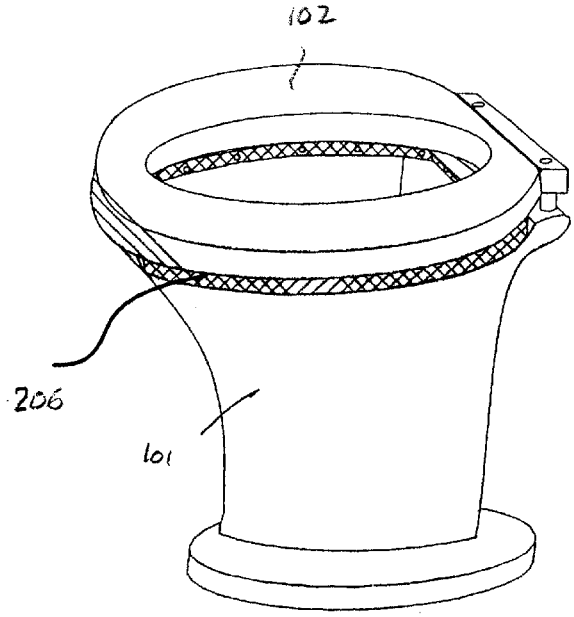

TOILET BOWL DEODORIZING AND DISINFECTING APPARATUS

STATEMENT OF RELATED CASES

This case claims priority of U.S. Provisional Application Serial. No. 60/326,883, filed Oct. 3, 2001, entitled "Toilet Bowl Deodorizing and Disinfecting Apparatus," which is also incorporated by reference herein.

FIELD OF THE INVENTION

The present invention relates generally to a deodorizing and disinfecting device for bathrooms. More particularly, the present invention relates to a deodorizing and disinfecting device for use with toilets.

BACKGROUND OF THE INVENTION

Toilets are known to be sources of unpleasant odors. To this end, a variety of toilet-deodorizing devices have been proposed.

Existing toilet-deodorizing devices typically include a pump that circulates odoriferous air through odor-adsorbing material. These devices vary in effectiveness and usually have some shortcomings.

SUMMARY OF THE INVENTION

A toilet bowl deodorizing, disinfecting and washing apparatus is disclosed. In one variation, the apparatus includes a flexible enclosure that contains a flexible air chamber or bellows, a high-pressure reservoir, a liquid reservoir, and a plurality of nozzles. The bellows, liquid reservoir, and nozzles are selectively placed in fluid communication with the high-pressure reservoir by the action of an actuating/valving system.

In use, the flexible enclosure is disposed beneath a toilet seat (or is itself a toilet seat). Deodorizing/disinfecting/washing liquid, which is contained in the liquid reservoir, is admitted to the high-pressure reservoir. When a person sits on the flexible enclosure, the bellows compresses air. The compressed air is admitted, by the action of the actuating/valving system, to the high-pressure reservoir, thereby pressurizing the deodorizing/disinfecting/washing liquid that is contained therein. The actuating/valving system prevents the pressurized liquid from being delivered to the nozzles.

As the person gets off the flexible enclosure, the actuating/valving system places the high-pressure reservoir in fluid-communication with the nozzles such that pressurized deodorizing/disinfecting/washing liquid is dispensed.

BRIEF DESCRIPTION OF THE DRAWINGS

FIG. 1 depicts a standard toilet bowl and toilet seat (tank and seat cover not shown).

FIG. 2 depicts a variation of a toilet bowl deodorizing and disinfecting apparatus in accordance with the illustrative embodiment of the present invention.

DETAILED DESCRIPTION

Figure 3:
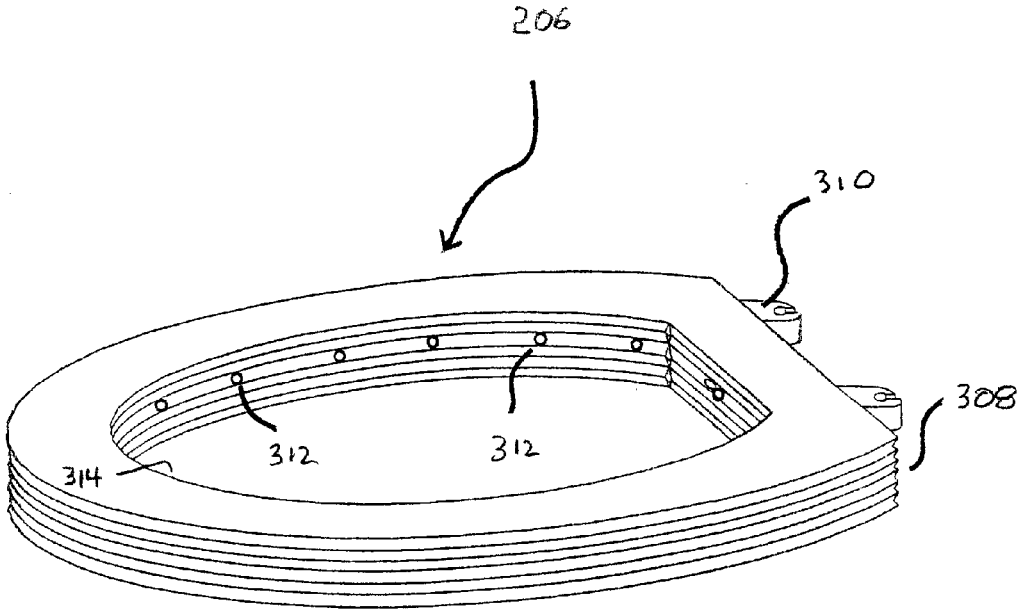
FIG. 3 depicts detail of the exterior of the toilet bowl deodorizing and disinfecting apparatus shown in FIG. 2.

For context, FIG. 1 depicts a standard toilet including bowl 101 and toilet seat 102 (tank and seat cover not shown). Seat 102 includes hinge 104, by which the seat is pivotally connected to toilet bowl 100. In a variation of the illustrative embodiment that is depicted in FIG. 2, toilet bowl deodorizing and disinfecting apparatus 206 is inserted between seat 102 and bowl 100. In another variation, toilet bowl deodorizing and disinfecting apparatus 206 is itself the toilet seat. The configuration of either of these variations of apparatus 206 is substantially the same.

FIG. 3 depicts a view of the exterior of toilet bowl deodorizing and disinfecting apparatus 206. As depicted in FIG. 3, apparatus 206 includes flexible enclosure 308 that has a shape that is substantially in the form of a toilet seat. In the variation depicted in FIG. 3, flexible enclosure 308 is "pleated," accordion style, to assure flexibility. Other configurations known to provide flexibility can suitably be used. Brackets 310 depending from the rear of flexible enclosure 308 are used to attach it to toilet bowl 100.

A plurality of orifices 312 are located along inner circumference 314 of flexible enclosure 308. Deodorizing liquid, washing liquid or disinfecting liquid (hereinafter collectively referred to in this Specification as "deodorizing liquid") is dispensed from the interior of flexible enclosure 308 through orifices 312.

Figure 4:
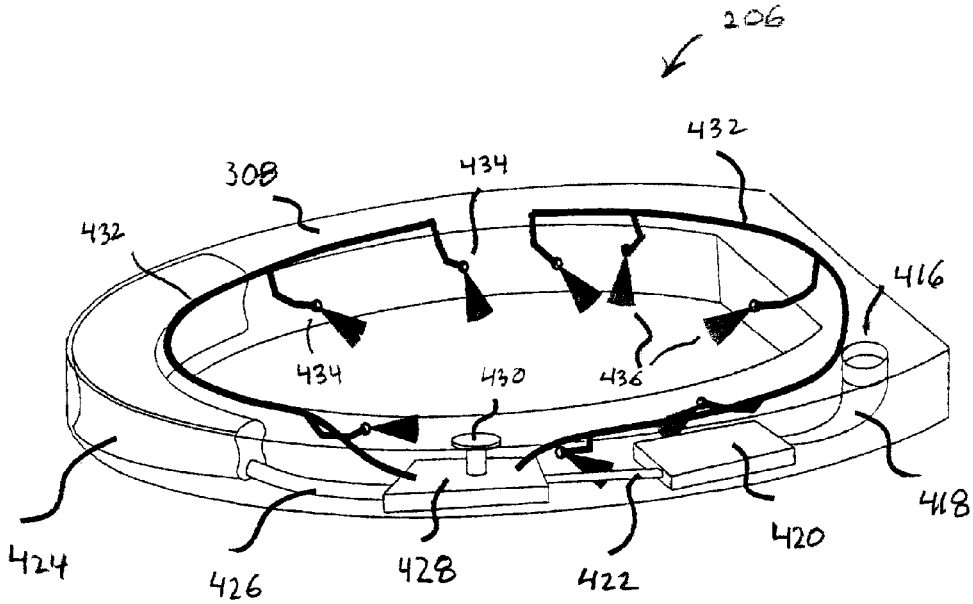
FIG. 4 depicts a detail of the interior of the toilet bowl deodorizing and disinfecting apparatus shown in FIG. 2.

FIG. 4 depicts a view of the interior of toilet bowl deodorizing and disinfecting apparatus 206. Inside of flexible enclosure 308 are liquid reservoir 420, flexible air chamber or bellows pump 424, high-pressure reservoir 428, and nozzles 434, interconnected as shown.

Liquid reservoir 420 receives and stores deodorizing liquid. Liquid reservoir 420 is charged with deodorizing liquid via filling orifice 416. Conduit 418 (e.g., tubing, etc.) carries the deodorizing liquid to liquid reservoir 420. Conduit 422 (e.g., tubing, etc.) carries deodorizing liquid from liquid reservoir 420 to high-pressure reservoir 428.

When flexible air chamber or bellows pump 424 is compressed, such as when a person sits on flexible enclosure 308 (or a toilet seat that rests on top of flexible enclosure 308), air within flexible air chamber 424 is compressed. The compressed air is directed to high-pressure reservoir 428 via conduit 426 (e.g., tubing, etc.), thereby pressurizing the deodorizing liquid within.

Pressurized, deodorizing liquid from high-pressure reservoir 428 is delivered, via conduit 432 (e.g., tubing, etc.) to nozzles 434. The nozzles, which align with orifices 312, produce a fine, directional mist 436 from the pressurized deodorizing liquid. Mist 436 is directed through orifices 312 towards the bottom of the toilet bowl. Nozzles suitable for creating a directional mist are available from Misty Mate Company of Gilbert, Ariz. (see, www.Mistymate.com). Nozzles 434 are advantageously directionally adjustable to accommodate various types and shapes of toilet bowls. This directional adjustability can be implemented, for example, by introducing a small pliable tube inside conduit 432 that leads to nozzle 434 or in other ways known to those skilled in the art. A screw-type in-line "choker" can be used to provide flow regulation.

Figure 5:
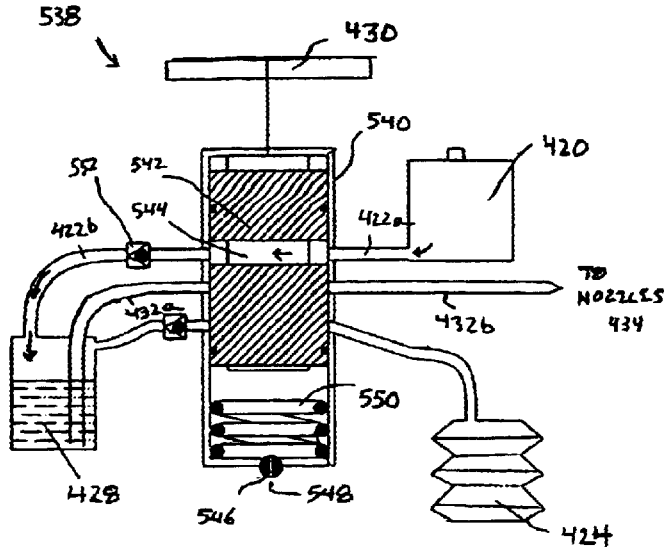
FIG. 5 depicts an actuating/valving arrangement for controlling flow of liquid and air into and out of the high-pressure reservoir.
Figure 6:
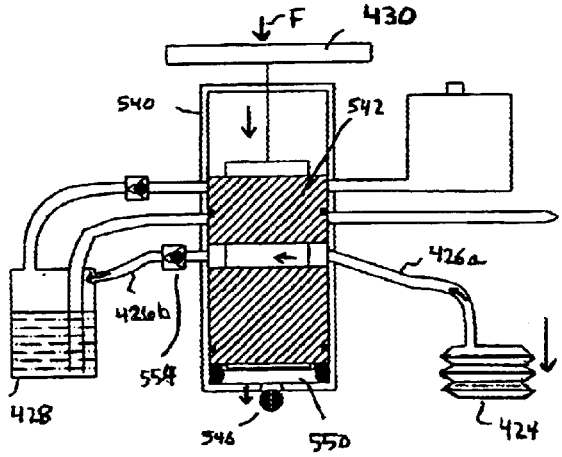
FIG. 6 depicts the actuating/valving arrangement of FIG. 5 when the actuator is depressed.
Figure 7:
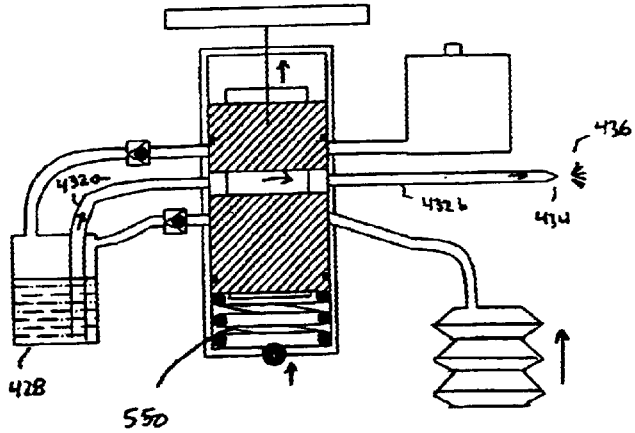
FIG. 7 depicts the actuating/valving arrangement of FIG. 5 when the actuator returns from its depressed state.

As indicated above, various charging and dispensing operations occur during use of toilet bowl deodorizing and disinfecting apparatus 206. These operations are controlled by an actuating/valving system, such as system 538, which is depicted in FIGS. 5–7. Illustrative actuating/valving system 538 includes actuating element 430, cylindrical body 540, piston 542 having passageway 544, check valve 546 and spring 550, interrelated as shown.

Actuating/valving system 538 advantageously provides the following functionality:

Selectively admits deodorizing liquid to enter high-pressure reservoir 428.

Selectively admits pressurized air into high-pressure reservoir 428.

Selectively releases pressurized deodorizing liquid to nozzles 434. Illustrative actuating/valving system 538 is configured as a combined actuating/valving element. In other variations of deodorizing and disinfecting apparatus 206, the actuating/valving system can be implemented as discrete actuating elements and valve elements, in known fashion.

FIG. 5 depicts actuating/valving system 538 in a state before a user has sat on flexible enclosure 308. Actuating element 430, which is rigidly linked to piston 542, is in its top or un-depressed position or state. In this state, passageway 544, which can be implemented as a groove that is disposed near the surface of piston 542, places liquid reservoir 420 in fluid communication with high-pressure reservoir 428. More particularly, in the illustrative embodiment, passageway 544 places the portion of conduit 422 that is located upstream of actuating/valving system 538 (i.e., portion 422*a*) in fluid communication with the portion of conduit 422 that is located downstream of actuating/valving system 538 (i.e., portion 422*b*). Consequently, deodorizing liquid from liquid reservoir 420 flows through passageway 544, past optional check valve 552 and into high-pressure reservoir 428.

When a downward-directed force is applied to actuating element 430, such as is the result of a user sitting on flexible enclosure 308, actuating element 430 and piston 542 moves downwardly in cylindrical body 540. Since check valve 546 opens fully, piston 542 drops quickly. Actuating element 430 and piston 542 are depicted in a bottom or fully-depressed position or state in FIG. 6.

The action of a user sitting down on flexible enclosure 308 also depresses flexible air chamber 424. This compresses the air within chamber 424. When piston 542 is at its bottom position, passageway 544 places flexible air chamber 424 in fluid communication with high-pressure reservoir 428. More particularly, in the illustrative embodiment, passageway 544 places the portion of conduit 426 that is located upstream of actuating/valving system 538 (i.e., portion 422*a*) in fluid communication with the portion of conduit 422 that is located downstream of actuating/valving system 538 (i.e., portion 426*b*). Consequently, pressurized air from flexible air chamber 424 flows through passageway 544, past optional check valve 554 and into high-pressure reservoir 428.

As piston 542 drops, passageway 544 briefly places portions 432*a* and 432*b* of conduit 432 in fluid communication. Consequently, a very small amount of pressurized deodorizing liquid leaves high-pressure reservoir 428. The amount of liquid escaping is so small that it is barely sufficient, at best, to prime conduit 432. As shown in FIG. 6, when piston 542 is at its bottom position, liquid flow from liquid reservoir 420 is blocked, pressurized liquid flow to nozzles 434 is blocked, and spring 550 is compressed.

When the downward-directed force is withdrawn from actuating element 430, spring 550 expands, moving actuating element 430 and piston 542 upward through cylindrical body 540, as depicted in FIG. 7. Piston 542 moves slowly upward, due to small orifice 548 in check valve 546. With continued upward movement, passageway 544 places high-pressure reservoir 428 in fluid communication with nozzles 434. More particularly, in the illustrative embodiment, passageway 544 places the portion of conduit 432 that is located upstream of actuating/valving system 538 (i.e., portion 432*a*) in fluid communication with the portion of conduit 432 that is located downstream of actuating/valving system 538 (i.e., portion 432*b*). Consequently, pressurized deodorizing liquid from high-pressure reservoir 428 is expelled through passageway 544 and to nozzles 434 where it is dispensed as fine, directional mist 436.

The amount of time that the deodorizing liquid sprays from nozzles 434, depends, in part, on the amount of time that portions 432*a* and 432*b* of conduit 432 are aligned. That amount of time is dependent upon the rate at which piston 542 rises. The rise rate of the piston is dependent upon the size of orifice 548 in check valve 546 (in addition to properties of spring 550). It is within the capabilities of those skilled in the art to determine orifice size and spring properties to obtain a desired spray time.

When pressurized deodorizing liquid is dispensing from high-pressure reservoir 428, check valves 552 and 554, in addition to the position of passageway 544, prevents pressurized deodorizing liquid from backing up into liquid reservoir 420 or flexible air chamber 424.

It is to be understood that the above-described embodiments are merely illustrative of the invention and that many variations may be devised by those skilled in the art without departing from the scope of the invention and from the principles disclosed herein. For example, in embodiments in which cylindrical body is appropriately dimensioned, check valves 552 and 554 are probably not required. Furthermore, in yet additional embodiments, one or more additional liquid reservoirs can be included in deodorizing and disinfecting apparatus 206. For example, in addition to the first liquid reservoir, which might contain a deodorizing liquid, a second liquid reservoir contains a disinfecting liquid. A third liquid reservoir might contain a cleaning liquid, etc. Modifying the illustrative embodiment to accommodate extra liquid reservoirs is within the capabilities of those skilled in the art. It is therefore intended that such variations be included within the scope of the following claims and their equivalents.

We claim:

1. An apparatus comprising:

a flexible enclosure that is shaped substantially in the form of a toilet seat;

a high-pressure reservoir that is disposed within said flexible enclosure;

a flexible air chamber that is disposed within said flexible enclosure, wherein said flexible air chamber generates pressurized air that is controllably delivered to and pressurizes said high-pressure reservoir;

a liquid reservoir that is disposed within said flexible enclosure, wherein said liquid reservoir receives a deodorizing liquid that is controllably flowed to said high-pressure reservoir; and a plurality of nozzles that receive deodorizing liquid from said high-pressure reservoir, wherein said nozzles dispense said deodorizing liquid to the exterior of said flexible enclosure.

2. The apparatus of claim 1 further comprising a first tube that connects said flexible air chamber to said high-pressure reservoir.

3. The apparatus of claim 1 further comprising a second tube that connects said liquid reservoir to said high-pressure reservoir.

4. The apparatus of claim 1 further comprising a filling orifice by which deodorizing liquid is added to said liquid reservoir.

5. The apparatus of claim 4 further comprising a third tube that connects said filling orifice to said liquid reservoir.

6. The apparatus of claim 1 further comprising tubing that places said plurality of nozzles in fluid communication with said high-pressure reservoir.

7. The apparatus of claim 1 further comprising:

an actuating/valving system that controls flow of said pressurized air from said flexible air chamber to said high-pressure reservoir.

8. The apparatus of claim 1 further comprising:

an actuating/valving system that controls flow of said deodorizing liquid from said liquid reservoir to said high-pressure reservoir.

9. The apparatus of claim 1 further comprising:

an actuating/valving system that controls flow of said deodorizing liquid from said high-pressure reservoir to said plurality of nozzles.

10. The apparatus of claim 1 further comprising an actuating/valving system that:

controls flow of said pressurized air from said flexible air chamber to said high-pressure reservoir;

controls flow of said deodorizing liquid from said liquid reservoir to said high-pressure reservoir; and controls flow of said deodorizing liquid from said high-pressure reservoir to said plurality of nozzles.

11. The apparatus of claim 10 wherein said actuating/valving system is actuated by the weight of a human body.

12. The apparatus of claim 1 wherein said flexible enclosure has two brackets that receive holding bolts of a toilet.

* * * * *